US007424920B2

(12) United States Patent
Bergstrand et al.

(10) Patent No.: US 7,424,920 B2
(45) Date of Patent: Sep. 16, 2008

(54) METHOD AND DEVICE FOR IMPACT LOOSENING OF THREAD JOINTS

(75) Inventors: Karin Bergstrand, Örebro (SE); Katarina Carlsson, Örebro (SE); Björn Lindgren, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 152 days.

(21) Appl. No.: 10/569,327

(22) PCT Filed: Sep. 24, 2004

(86) PCT No.: PCT/SE2004/001371

§ 371 (c)(1),
(2), (4) Date: Feb. 17, 2006

(87) PCT Pub. No.: WO2005/033468

PCT Pub. Date: Apr. 14, 2005

(65) Prior Publication Data

US 2007/0007040 A1 Jan. 11, 2007

(30) Foreign Application Priority Data

Oct. 6, 2003 (SE) ..... 03022625

(51) Int. Cl.
*E21B 44/00* (2006.01)

(52) U.S. Cl. ..... 175/24; 175/40; 173/1; 173/2; 173/4

(58) Field of Classification Search ... 414/22.51–22.71; 175/52, 85, 24, 40; 166/53
See application file for complete search history.

(56) References Cited

U.S. PATENT DOCUMENTS

| | | | | | |
|---|---|---|---|---|---|
| 3,920,087 | A | * | 11/1975 | Hisey et al. | 173/164 |
| 4,449,592 | A | * | 5/1984 | Mayer | 175/52 |
| 4,515,045 | A | * | 5/1985 | Gnatchenko et al. | 81/429 |
| 4,707,687 | A | * | 11/1987 | Thomas et al. | 340/680 |
| 4,935,884 | A | * | 6/1990 | Hajicek | 702/159 |
| 5,138,875 | A | * | 8/1992 | Booer | 73/152.47 |
| 5,141,061 | A | * | 8/1992 | Henneuse | 175/56 |
| 5,170,358 | A | * | 12/1992 | Delio | 700/177 |
| 5,303,162 | A | * | 4/1994 | Yoon | 702/33 |
| 5,465,798 | A | * | 11/1995 | Edlund et al. | 175/24 |

(Continued)

FOREIGN PATENT DOCUMENTS

WO 0236925 5/2002

*Primary Examiner*—David J. Bagnell
*Assistant Examiner*—Cathleen R Hutchins
(74) *Attorney, Agent, or Firm*—Mark P. Stone

(57) ABSTRACT

A method and device for detecting and responding to impact loosening of thread joints at rock drilling, in which vibrations from a drill string (1) are sensed at the same time as a rock drilling machine (2) movable along a feed beam (6) exerts the drill string (1) to impacts without feeding the drill string (1) against a ground (3), the sensed vibrations are supplied to an analysis tool (4), the sensed vibrations are compared with known vibration patterns by the analysis tool, and a signal is sent to a control system (5) for controlling the rock drilling machine (2) for stopping an impact device of the rock drilling machine when the analysis tool detects that the sensed vibrations correspond to a known vibration pattern indicating that the thread joints have been loosened by impact.

2 Claims, 1 Drawing Sheet

U.S. PATENT DOCUMENTS 5,711,382 A * 1/1998 Hansen et al. ..... 175/52
6,179,065 B1 * 1/2001 Payne et al. ..... 175/24
6,508,313 B1 * 1/2003 Carney et al. ..... 173/1
6,510,902 B1 * 1/2003 Prokop et al. ..... 173/1
6,567,006 B1 * 5/2003 Lander et al. ..... 340/605
6,687,567 B2 * 2/2004 Watanabe ..... 700/168
2001/0000550 A1 * 5/2001 Newman ..... 29/714
2002/0124652 A1 9/2002 Schultz et al.
2003/0037423 A1 * 2/2003 Siegel ..... 29/407.01
2004/0074652 A1 * 4/2004 Ginell ..... 173/2
2005/0077084 A1 * 4/2005 Kracik et al. ..... 175/24

* cited by examiner

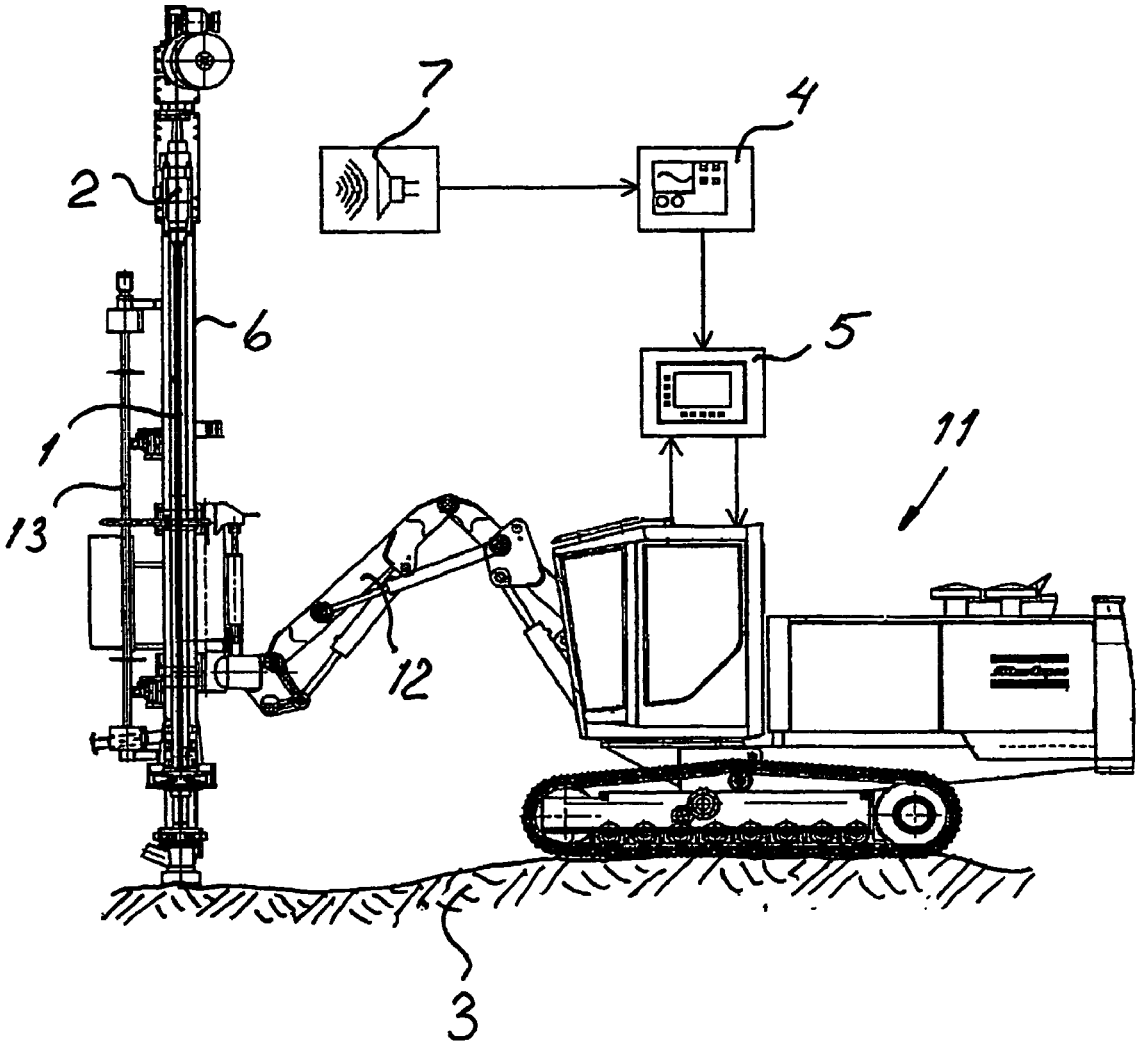
7
4
2
6
5
1
11
13
12
3

METHOD AND DEVICE FOR IMPACT LOOSENING OF THREAD JOINTS

BACKGROUND OF THE INVENTION

The present invention relates to a method and a device for detection of impact loosening of thread joints at rock drilling.

When drilling long holes in a ground, for example rock, several rods are used which are screwed together in order to lengthen the drill string as needed during the drilling. The tightening of the threads normally becomes so firm as a consequence of the shock waves passing the thread joints during drilling, that the thread joints cannot be loosened only with the assistance of the rotation motor of the rock drilling machine. In order to solve this problem, the operator ends the drilling by letting the impact device exert the drill string to impacts for a short while without pressing the drill string against the ground. The operator stops the impact device when a characteristic change of sound is heard. After that, the drill string can be unscrewed with the rotation motor of the rock drilling machine, and the separate drill rods can be picked up one by one. A drawback of this method is that one cannot automate the taking up of the drill string when automatic drilling has occurred. Another drawback is that the operator has difficulties in hearing that the impact loosening has occurred at an early stage because of the noisy environment. This gives rise to unnecessary wear on the drilling equipment.

SUMMARY OF THE INVENTION

The primary object of the present invention, is to achieve detection of impact loosening of thread joints to make possible automatic drilling of a drill hole, including automatic taking up of the drill string after the drilling itself, so that one thereafter can position the drilling device for the drilling of a new hole. Another object of the invention is to avoid unnecessary loads on the drilling through early detection of the impact loosening of the thread joints. This is achieved mainly through sensing the vibrations emitted by the drilling equipment when the rock drilling machine is impacting the drill string without feeding the drill string against the ground. The sensing can be achieved through using either a microphone or a vibration sensor for other frequencies. The sensed vibrations are compared with known vibration patterns characteristic for impact loosening in an analysis tool. These vibration patterns can be either a characteristic change of the vibrations from the drilling equipment, or a characteristic shape of the vibrations after impact loosening has occurred. When the analysis tool has detected that the impact loosening has taken place, a signal is sent to the control system of the drill rig which shuts off the impact device, after which the drill string is automatically taken up rod by rod.

BRIEF DESCRIPTION OF THE DRAWINGS

An embodiment of the invention is described below with reference to the accompanying drawing which schematically shows the methods and devices of the present invention incorporated in rock drilling equipment.

DESCRIPTION OF THE BEST MODE FOR CARRYING OUT THE INVENTION

The rock drilling equipment shown in the drawing comprises a carrier 11 supported on a ground 3 and provided with a boom 12 on which a feed beam 6 is arranged. A rock drilling machine 2 is movable to-and-fro along the feed beam. The rock drilling machine 2 comprises an impact device for exerting a drill string 1 to impacts, and a rotation device, arranged in a known manner. The drill string 1 may comprise an arbitrary number of drill rods which are connected to each other by means of thread joints. A microphone or other vibration sensing device 7 is arranged on the feed beam 6 or at another suitable position. The device 7 is connected to an analysis tool 4 which suitably comprises a filter to separate relevant frequencies for frequency analysis, and to decrease the amount of data to be handled. The analysis tool 4 can be arranged to work either digitally or analogically. In the analysis tool 4, the sensed vibrations are compared with known vibration patterns, which may either be a typical change of the character of the vibration, or discovery of a vibration pattern which is typical for the impact loosened thread joint. When the impact loosening is detected, a signal is send to the control system 5 of the drilling equipment which then turns off the impact device. After that, the drill string 1 can be picked up automatically and placed in the rod magazine 13, rod by rod.

The drilling equipment shown in the drawing is intended for surface use. The invention is equally suitable for use at a long hole drilling underground, as for example, in connection with grouting.

The invention claimed is:

1. Method of detecting and responding to impact loosening of thread joints at rock drilling, the steps of said method comprising: sensing vibrations from a drill string (1) at the same time as a rock drilling machine (2) exerts the drill string (1) to impacts without feeding the drill string (1) against a ground (3), supplying the sensed vibrations to an analysis tool (4), comparing the sensed vibrations with known vibration patterns by the analysis tool, and sending a signal to a control system (5) for controlling the rock drilling machine (2) for stopping an impact device of the rock drilling machine when the analysis tool detects that the sensed vibrations correspond to the known vibration pattern indicating that the thread joints have been loosened by impact.

2. Device for detecting and responding to impact loosening of thread joints at rock drilling, said device comprising a rock drilling machine (2) movable along a feed beam (6) for exerting a drill string (1) to impacts, said device comprising a device (7) for sensing of vibrations from the drill string (1), an analysis tool (4) for comparing the sensed vibrations with known vibration patterns, the analysis tool (4) being arranged to send a signal when the sensed vibrations correspond to the known vibration pattern indicating that the thread joints have been impact loosened, and a control system (5) for controlling the rock drilling machine (2), the control system (5) being arranged to turn off an impact device of the rock drilling machine (2) when the analysis tool sends the signal.

* * * * *